US009521897B2

(12) United States Patent
Thompson

(10) Patent No.: US 9,521,897 B2
(45) Date of Patent: Dec. 20, 2016

(54) CUSTOMIZABLE MOLLE ADAPTER PANEL

(71) Applicant: Fechheimer Brothers Company, Cincinnati, OH (US)

(72) Inventor: Jesse Thompson, North Bend, WA (US)

(73) Assignee: The Fechheimer Brothers Company, Cincinnati, OH (US)

( * ) Notice: Subject to any disclaimer, the term of this patent is extended or adjusted under 35 U.S.C. 154(b) by 0 days.

(21) Appl. No.: 14/589,502

(22) Filed: Jan. 5, 2015

(65) Prior Publication Data

US 2015/0189977 A1 Jul. 9, 2015

Related U.S. Application Data

(60) Provisional application No. 61/923,824, filed on Jan. 6, 2014.

(51) Int. Cl.
*A45F 5/02* (2006.01)

(52) U.S. Cl.
CPC ..... *A45F 5/02* (2013.01); *Y10T 24/1382* (2015.01)

(58) Field of Classification Search
CPC A45F 5/02; A45F 2005/023; A45F 2003/003; A45F 5/00
See application file for complete search history.

(56) References Cited

U.S. PATENT DOCUMENTS 5,012,964 A * 5/1991 Falletta ..... B63C 11/26 224/153
5,724,707 A 3/1998 Kirk et al.
5,991,925 A 11/1999 Wu
6,000,509 A * 12/1999 Chisholm ..... A45C 13/02 150/113
7,036,420 B1 * 5/2006 Kummerer ..... F42B 39/30 190/109
7,080,430 B2 7/2006 Wemmer
7,200,871 B1 4/2007 Carlson
7,251,867 B2 8/2007 Wemmer
7,526,842 B2 5/2009 Wemmer
7,694,862 B2 4/2010 Bergeron
7,845,527 B1 12/2010 McMillan et al.
8,608,041 B1 12/2013 Adkisson
8,910,410 B2 * 12/2014 Peters ..... F41C 33/006 224/197
2007/0175941 A1 * 8/2007 Berry ..... A45C 7/0077 224/583
2008/0277433 A1 * 11/2008 Karl ..... A45F 3/04 224/148.6
2009/0117300 A1 * 5/2009 Thompson ..... A45F 5/02 428/35.2

(Continued)

FOREIGN PATENT DOCUMENTS

CA 2561981 A1 4/2007
WO 2009128801 A1 10/2009

*Primary Examiner* — Brian D Nash
(74) *Attorney, Agent, or Firm* — Wood Herron & Evans LLP

(57) ABSTRACT

An adapter for connecting an article having MOLLE webbing thereon to a surface having no MOLLE webbing thereon comprises an intermediate panel in which is provided a plurality of slots, and on one side of which is provided a hook-and-loop fastener component for selectively attaching the panel to said surface. Straps connect the article to the panel while the fastener component connects the panel to a surface.

8 Claims, 6 Drawing Sheets

(56) References Cited

U.S. PATENT DOCUMENTS

| | | | | |
|---|---|---|---|---|
| 2010/0224660 | A1* | 9/2010 | Gleason | A45F 3/047 224/264 |
| 2011/0191933 | A1* | 8/2011 | Gregory | A41D 13/0012 2/69 |
| 2011/0278338 | A1* | 11/2011 | Darnell, II | A45F 3/04 224/637 |
| 2012/0091173 | A1* | 4/2012 | Crye | F41A 9/65 224/196 |
| 2012/0318837 | A1* | 12/2012 | Yaeger | A45F 3/06 224/665 |
| 2013/0098961 | A1* | 4/2013 | Strum | A45F 5/00 224/660 |
| 2013/0126566 | A1* | 5/2013 | Seuk | A45F 5/00 224/223 |
| 2014/0263519 | A1* | 9/2014 | Saucedo | A45F 3/08 224/633 |
| 2015/0192387 | A1* | 7/2015 | Thompson | F41C 33/0209 224/243 |
| 2015/0201761 | A1* | 7/2015 | Wollenberg | A47D 13/025 224/576 |

* cited by examiner

CUSTOMIZABLE MOLLE ADAPTER PANEL

RELATED APPLICATION

This application claims priority to and incorporates by reference the disclosure of U.S. Provisional Patent Application No. 61/923,824, filed Jan. 6, 2014.

FIELD OF THE INVENTION

This invention relates to a load carrying and article attachment apparatus wherein one article is attached to another. More particularly, this invention relates to improvements in such apparatus, which is typically referred to as a MOLLE system, and provides a device for adapting MOLLE-type attachable articles for attachment with hook-and-loop type material.

BACKGROUND

MOLLE is an acronym for Modular Lightweight Load-carrying Equipment. It is used to define the current generation of load-bearing equipment and rucksacks utilized by a number of NATO armed forces, especially the British Army and the United States Army. See, for example, U.S. Pat. No. 5,724,707, issued Mar. 10, 1998. The system's modularity is derived from the use of PALS webbing as rows of heavy-duty nylon stitched onto the vest to allow for attachment of various MOLLE-compatible pouches and accessories.

The Pouch Attachment Ladder System (PALS) is a grid of webbing used to attach smaller equipment onto load-bearing platforms, such as vests and backpacks. PALS consists of webbing sewn onto the load-bearing equipment and corresponding webbing and straps on the attachment. The straps are interwoven between the webbing on each of two pieces and finally snapped into place, making for a very secure fit which can be detached with moderate effort. The PALS grid consists of horizontal rows of 1 inch (2.5 cm) Mil-W-43668 Type III nylon webbing (most commercial vendors use Type IIIa), spaced 1 inch apart, and reattached to the backing at 1.5 inch (3.8 cm) intervals.

PALS and the MOLLE system were first used on rucksacks, but are now found on a variety of tactical equipment, including vests and other carry/storage devices. PALS webbing and the MOLLE-type attachment straps have become standardized so that they are universally compatible. They are used to attach items such as holsters, magazine pouches, radio pouches, knife sheathes, and other gear. A wide variety of pouches are commercially available, allowing soldiers or civilian law enforcement tactical units to customize how they carry their equipment and supplies.

In such MOLLE systems, as noted above, webbing is secured in rows on both articles to be attached together; the rows typically being stitched, for example, at intervals thereacross leaving intermittent webbing portions, between intermittent lines of stitching, unattached. The rows of webbing on the items are parallel and typically either horizontally or vertically oriented. When the two articles are juxtaposed, the webbing rows on one of the articles are offset from the webbing rows on the other article. Again, see U.S. Pat. No. 5,724,707.

One or more flexible straps (MOLLE-type straps) on the items are then interwoven through the adjacent webbing rows, securing the two articles together. Snap-together or yieldable latches at the ends of each strap are connected and the articles are secured together. The straps can be selectively released and the articles repositioned with respect to each other to orient them in a desired manner, limited both by the number or extent of the rows of webbing on each, and by the direction of extension of the webbing.

It is that limitation to which this invention is directed. Given two articles with rows of webbing secured to each, the possible placement and connection of one article to the other is limited by the location and extent of the webbing. Such a system then cannot accommodate placement of the article relative to a second article significantly offset therefrom and beyond the webbing. For example, it may be desired to secure a pouch to a pack, vest, or belt in an area where there are no corresponding rows of webs. Or, it may be desired to secure a pouch at an angle relative to the rows of webbing.

It is thus accordingly desired to be able to interconnect one article to another via a MOLLE-style attachment but without the limited spatial orientation inherent in current MOLLE/PALS systems.

SUMMARY OF THE INVENTION

The present invention provides a flat panel having a hook-and-loop (such as a VELCRO® or other brand) surface with pre-cut slots in a grid or pattern and accommodating a MOLLE attachment system of any desired configuration. The panel may be cut into any desired size or shape and can easily be secured to a hook-and-loop surface on a vest, pack or any surface onto which MOLLE-compatible surface is desired.

These and other aspects, features and details of the invention may be understood from a review of the detailed description, drawing figures, and claims, all of which comprise disclosure of the invention.

BRIEF DESCRIPTION OF THE DRAWING

Like reference numerals are used to indicate like parts throughout the various figures of the drawings, wherein.

DETAILED DESCRIPTION

The present invention provides a flat panel having at least one hook-and-loop (such as a VELCRO® or other suitable form) surface with at least one series of pre-cut apertures or slots. Each series of apertures are sized and positioned to accommodate a standard attachment strap of a MOLLE attachment system. The panel may include a plurality of series of apertures, arranged in a grid or pattern of any desired configuration to accommodate attached articles having multiple MOLLE-type attachment straps. The panel may be cut into any desired size or shape and can easily be secured to a hook-and-loop surface on a vest, pack, or any surface onto which MOLLE-compatible surface is desired.

As used herein, "hook-and-loop" engagement material is used to describe an attachment means that includes two separable component surfaces: a "hook" component and a "loop" or "pile" component. VELCRO® is a common brand name under which such material is produced and sold. Fabric used as the loop or pile component may be material not especially intended for such use, but having sufficient nap to engage the hook component.

Figure 1:
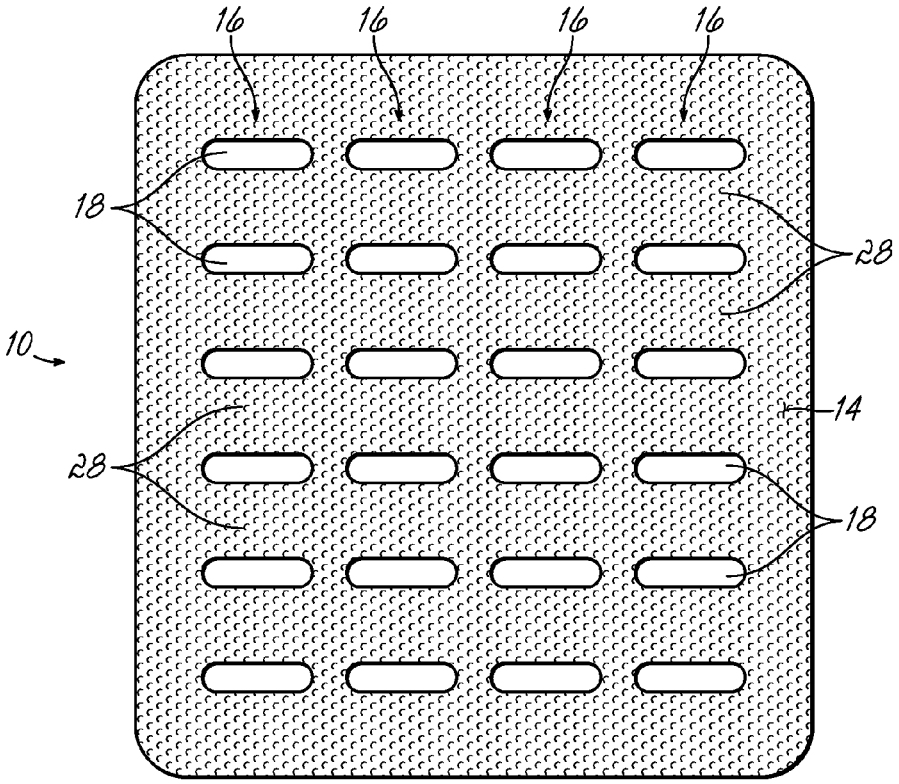
FIG. 1 illustrates one side of an adapter panel of the invention having a plurality of series of aperture slots therein arranged in a grid pattern and having a surface providing hook components of a hook-and-loop engagement material thereon.
Figure 2:
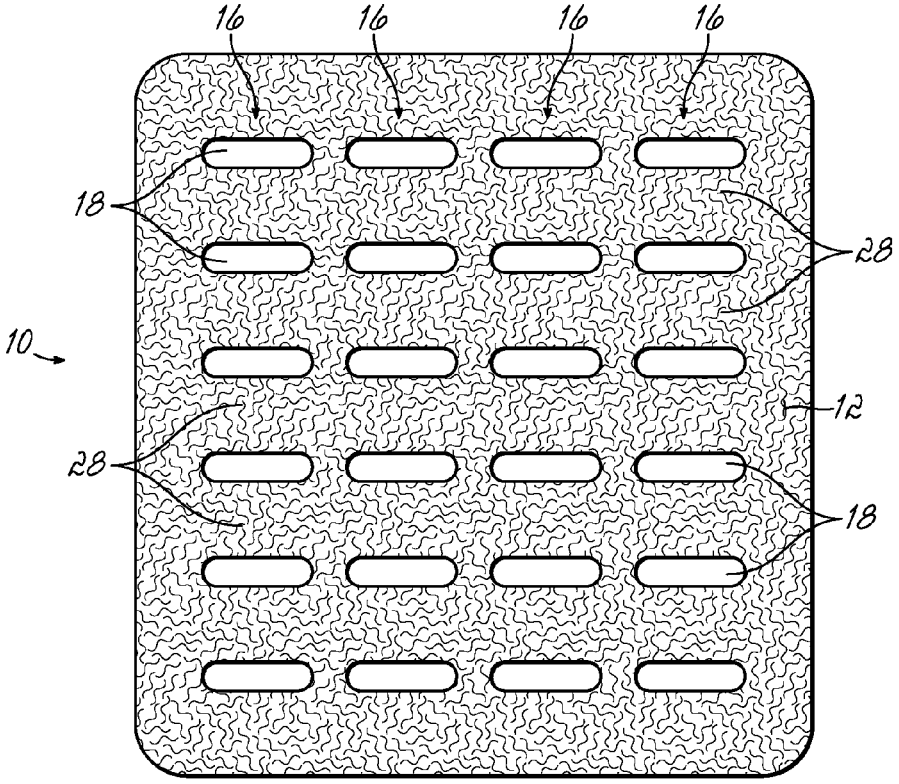
FIG. 2 illustrates the opposite side of the panel of FIG. 1, having a surface providing the loop component of a hook-and-loop engagement material thereon.
Figure 3:
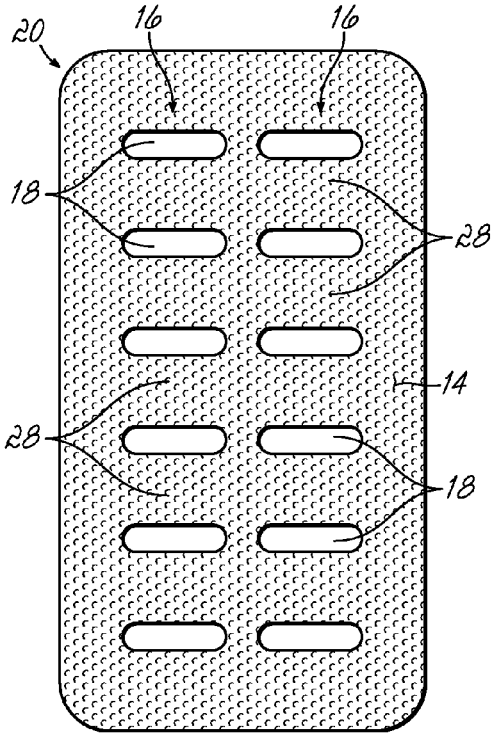
FIGS. 3 and 4 illustrate an alternate form of the panel having two series of aperture slots therein.
Figure 4:
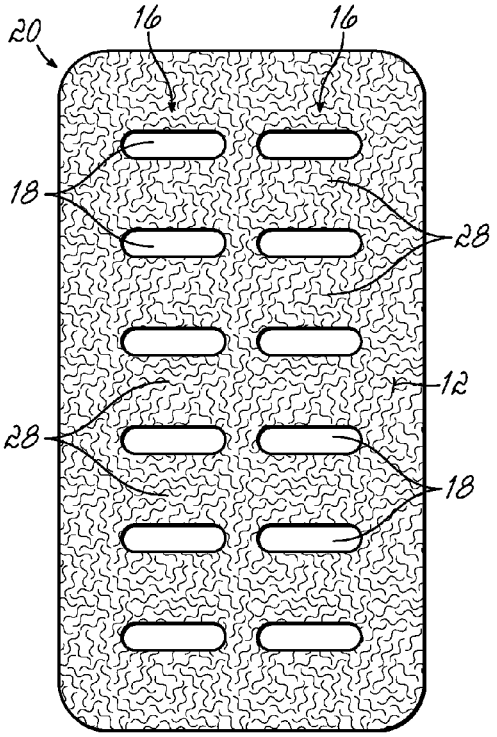
Figure 5:
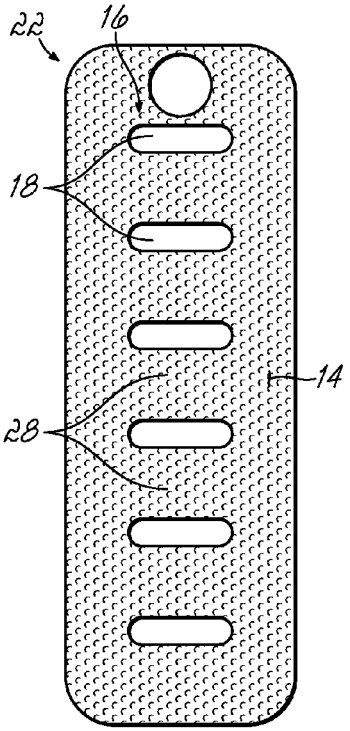
FIGS. 5 and 6 illustrate an alternate form of the panel having a single series of aperture slots therein.
Figure 6:
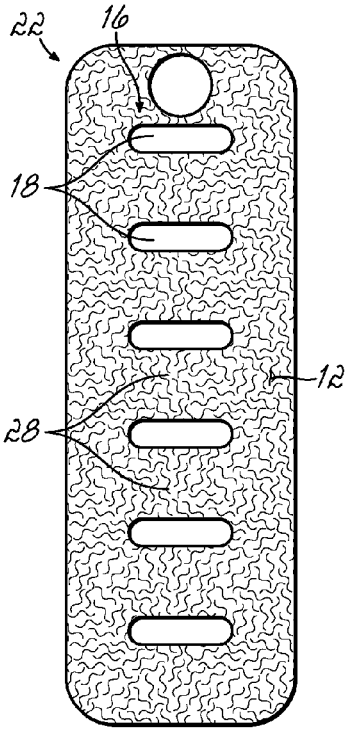
Figure 7:
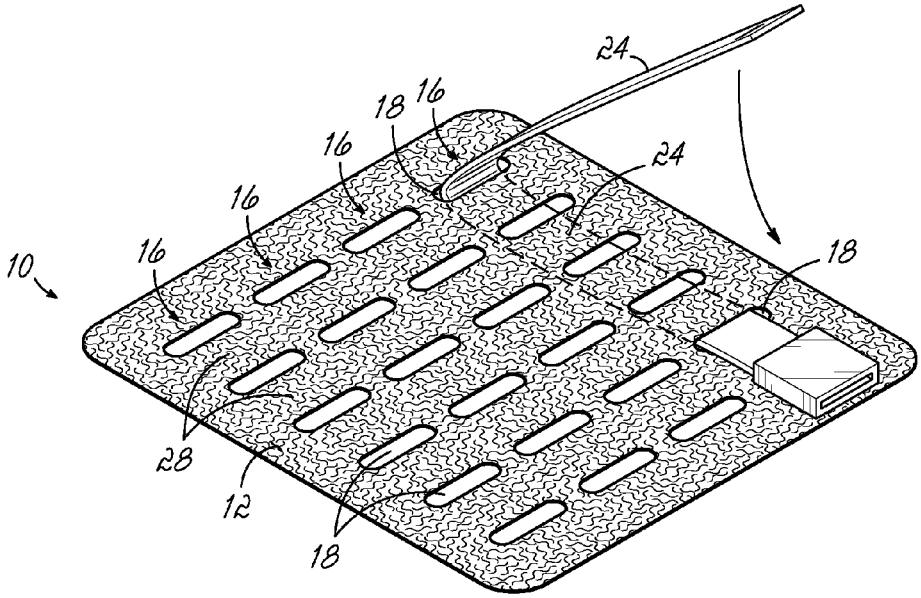
FIG. 7 initial threading of a flexible MOLLE-style strap in the slots of the panel of FIG. 1 (for clarity the article being attached is not shown)
Figure 8:
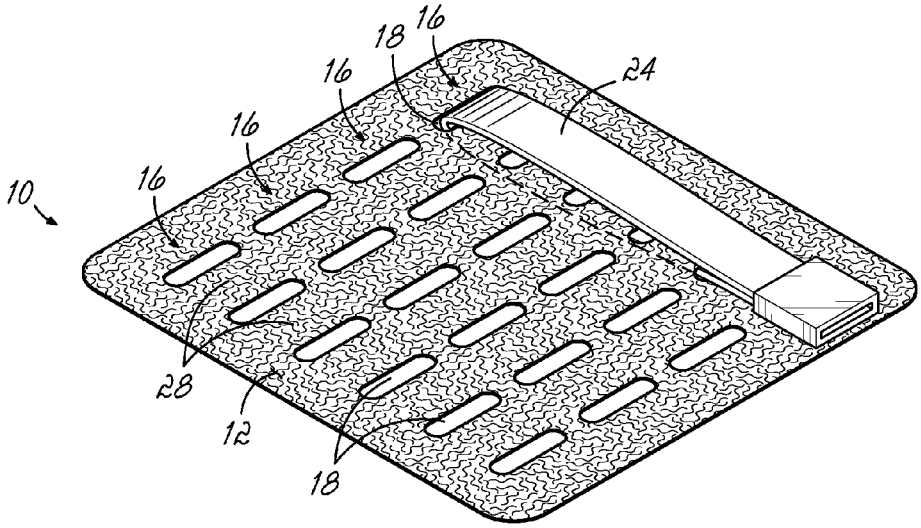
FIG. 8 illustrates the MOLLE-style strap interlaced with the panel and with strap ends fastened together.
Figure 9:
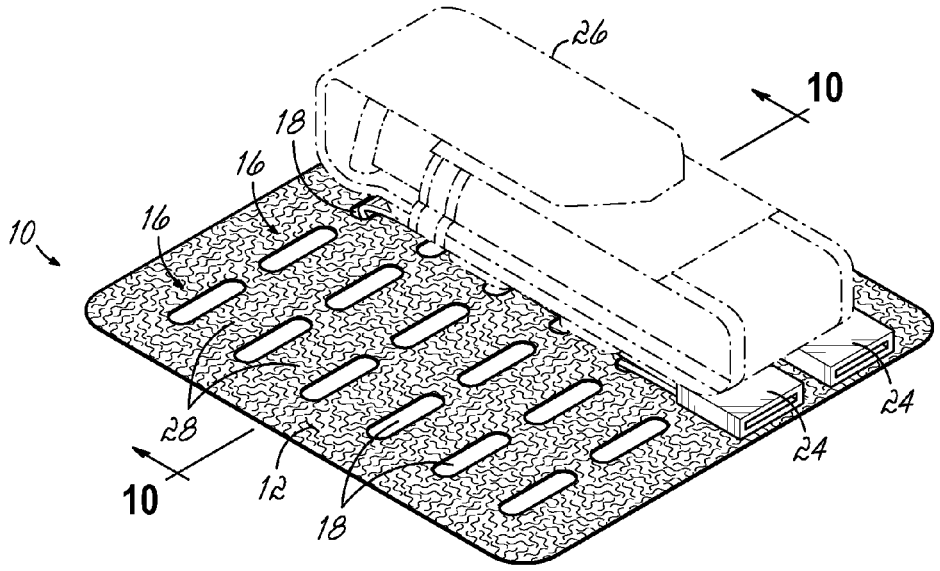
FIG. 9 illustrates the article (shown in phantom line) attached to one surface of the adapter panel.
Figure 10:
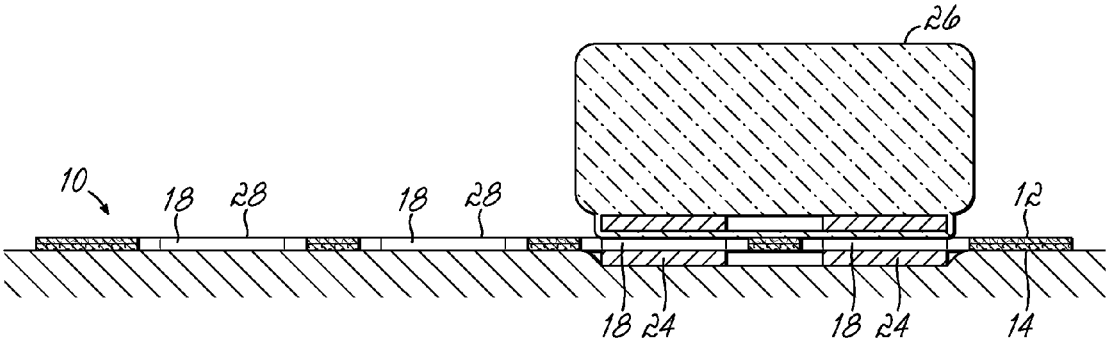
FIG. 10 is a sectional view taken substantially along line 10-10 of FIG. 9.

Referring first to FIGS. 1 and 2, therein is shown at 10 an adapter panel according to one embodiment of the present invention having a first side surface 12 and a second side surface 14. The panel 10 has four series 16 of aperture slots 18. In this example, the multiple series of slots are arranged in a grid-like pattern with substantially aligned columns and rows. Also in this example, each series 16 includes six slots 18, although any number of slots that permits acceptable engagement may be acceptable. FIGS. 3 and 4 show opposite sides of a panel 20 having two series 16 of slots 18; FIGS. 5 and 6 show opposite sides of a panel having only one series 16 of slots 18. The embodiment of FIGS. 1 and 2 will be used in subsequent figures to illustrate one example of the invention.

Referring now to FIGS. 7-10, the panel 10 accepts one or more of the aforementioned straps 24 of the MOLLE system, engaging the web rows (not shown) on the attached article (shown in phantom line at 26) to be attached. The flexible strap(s) 24 of the object to be attached 26 may be interlaced or woven through the slots 18 and the webbing area 28 between the slots 18. It will be appreciated that, typically, the attachment 26, such as a pocket, does not flex significantly but is provided with spaced rows of webbing through which the straps 24 are interwoven, providing secure attachment to the panel 10 and accommodating a variable positioning of the article 26 to be attached to the panel 10. The panel 10 is moveable and selectively positioned on a surface of the other article receiving the attached article, as will be described later. Although not illustrated in the drawings for sake of simplicity, it will be appreciated that the MOLLE straps 24 may be woven through the slots 18 and cross-webbing of the attachment 26 (not shown) as is well known in the field, or can be assembled as shown when less flexible attachment straps 24 are used.

The slots 18 may be simple slits that will allow passage of the attachment strap 24, or may be elongated cut-out openings, as illustrated. The hook-and-loop material may cover the entirety of a surface 12, 14 of the panel 10, or may be applied only to certain areas. According to one embodiment, the panel 10 is simply cut from a laminated or otherwise assembled sheet of fabric with hook components on one side and loop components on the other. One such fabric is sold by Velcro USA Inc. of Manchester N.H., under the trademark ONE-WRAP®.

Figure 11:
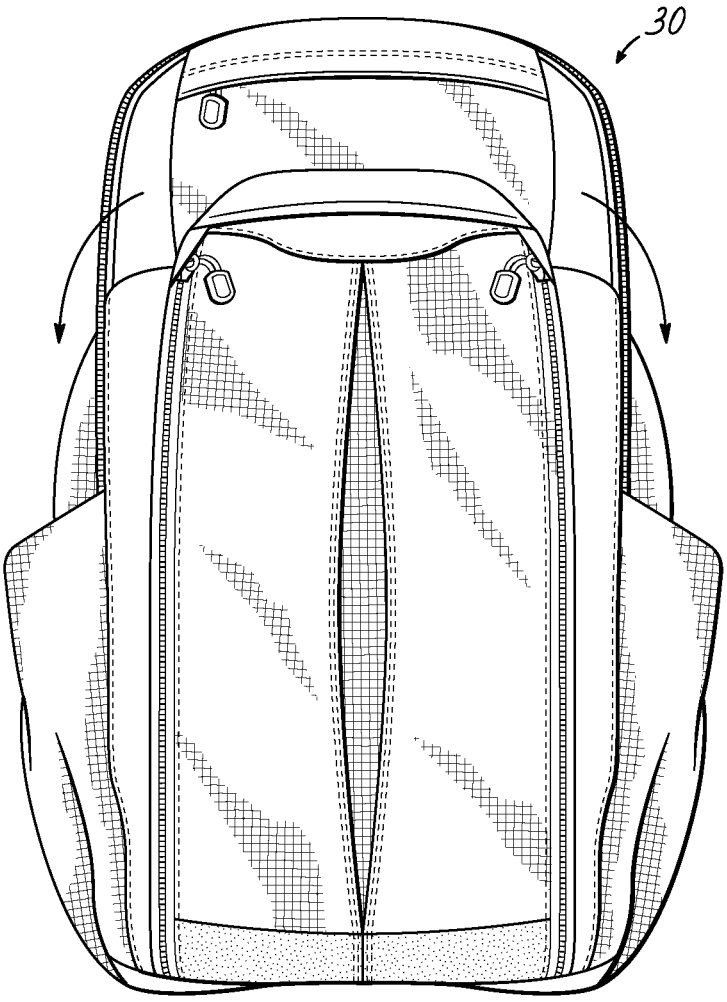
FIG. 11 illustrates an example of a second article, such as a pack, to which a first article may be attached.
Figure 12:
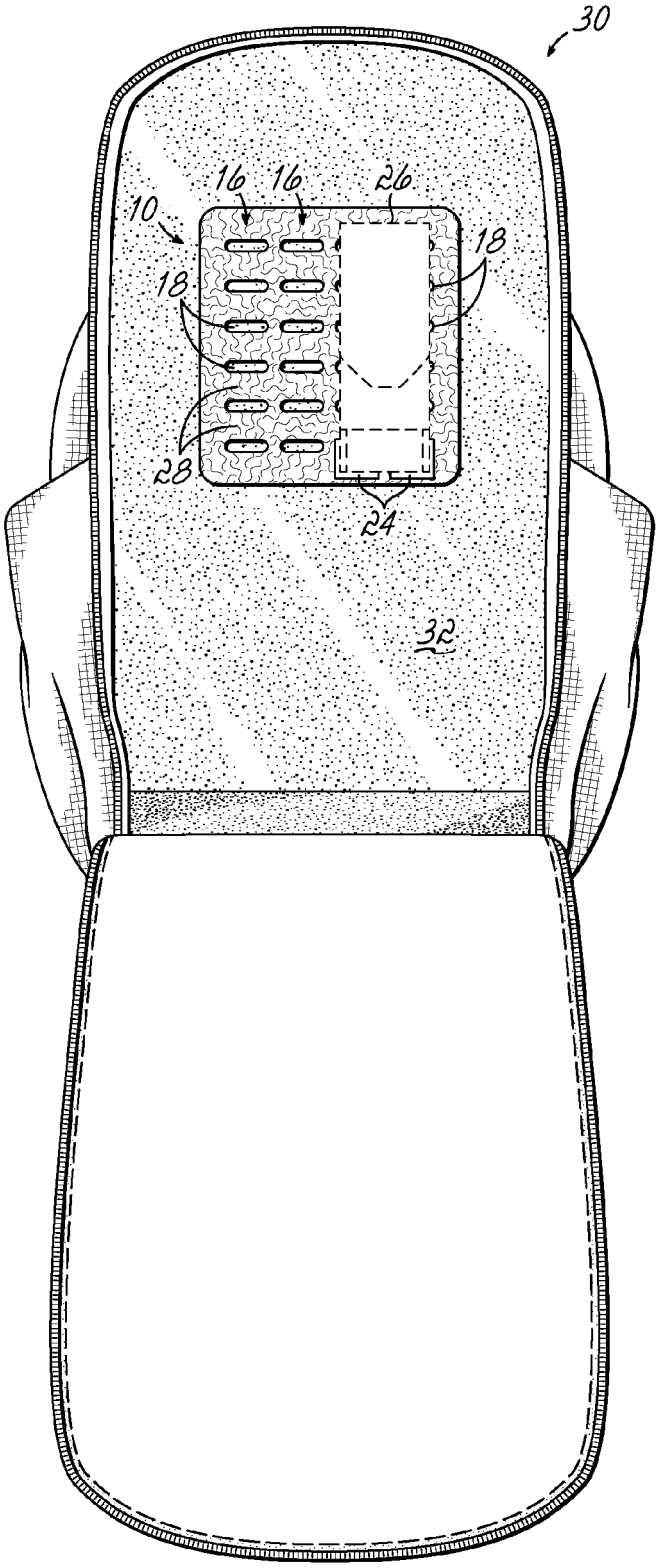
FIG. 12 illustrates the pouch secured to the panel, shown in FIGS. 9 and 10, attached to an interior surface of a receiving article, such as a pack.

Referring now to FIGS. 11 and 12, the second or receiving article may be, for example, a pack 30. An interior surface 32 (or exterior surface) may include a complementary component of the hook-and-loop attachment material. Generally, because the hook component is typically rough to the tough and can unintentionally engage the nap of many fabrics or materials, material comprising the loop or pile component is used as the lining or other surface of the receiving article. The placement of the hook-and-loop components may, however, be interchanged as desired. If the panel 10 is made from a two-sided material, as described above, the panel 10 may be reversed, as needed, to engage whichever complementary attachment surface is available on the receiving article 30.

The panel 10 can be oriented with series of slots vertically or horizontally disposed, or at other angles relative to the surface of the receiving article in order to provide not only positional location of the attached article on the receiving article but angular or rotational orientation as well, at the point of use or attachment together of the two articles in use or in the field, for example.

The panel 10 is thus moveable across and able to be placed on significant areas of the receiving article 10 having no web rows (PALS webbing), but nevertheless providing a series 16 or grid of apertures 18 for receiving the straps 24 on the attached article 26 extended through the apertures 18 of the panel 10 forming web rows. The receiving article is provided with surfaces having complimentary hook-and-loop material on such components so as to receive the panel in a wide variety of areas on the receiving article.

While the illustrations demonstrate a somewhat simplified illustration of the connection between the panel and the receiving article, in some embodiments of the invention, additional joining fasteners or straps may be employed. Further, in some embodiments of the invention, the panel may be mated to the receiving article by way of interleaved straps or joining fasteners. Additionally, in some embodiments, straps or joining fasteners may be woven and passed through the panel or receiving article at a plurality of locations to improve the rigidity of the spatial relationship between the panel and the receiving article.

While exemplary embodiments of the present invention have been illustrated and described in detail, it should be apparent that other modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. An apparatus for attaching a first article to a second article, the first article having at least one MOLLE-type attachment strap, the apparatus comprising:

a panel separate from the first and second articles, the panel having first and second surfaces; and at least one series of apertures extending completely through the first and second surfaces of the panel, the at least one series of apertures being sized and positioned to engage the at least one MOLLE-type attachment strap such that the first article is secured against one of the first or second surfaces of the panel, the other of the first or second surfaces having one component of a hook-and-loop engagement material, wherein the panel with the first article secured thereto is selectively positionable for attachment to the second article, the second article having a surface with the other component of a hook-and-loop engagement material.

2. The apparatus of claim 1, wherein one of the first or second surfaces of the panel includes the hook component and the other of the first or second surfaces of the panel includes the loop component of a hook-and-loop engagement material allowing the apparatus to be reversed to engage the surface of the second article having either a loop component or a hook component of a hook-and-loop engagement material.

3. The apparatus of claim 1, wherein the panel includes a plurality of series of apertures.

4. The apparatus of claim 3, wherein the plurality of series of apertures are arranged in a grid pattern in which rows and columns of apertures are substantially aligned.

5. The apparatus of claim 1, wherein the apertures are elongated slots.

6. In combination, an article attachment adaptor system, comprising:

a first article having at least one MOLLE-type attachment strap;

a second article having a surface with one component of a hook-and-loop engagement material; and a panel separate from the first and second articles, the panel having first and second surfaces and at least one series of apertures extending completely through the first and second surfaces of the panel, the at least one series of apertures being sized and positioned to engage the at least one MOLLE-type attachment strap, wherein the first article is secured against one of the first or second surfaces of the panel, the other of the first or second surfaces having the complementary component of a hook-and-loop engagement material, such that the panel with the first article secured thereto is selectively positionable for attachment to the surface of the second article.

7. The apparatus of claim 1, wherein the second article does not include a PALS-type webbing area.

8. A MOLLE-type connection to hook-and-loop connection adapter for attaching a first article to a second article, the adapter comprising:

a panel having first and second surfaces; and at least one series of apertures extending completely through the first and second surfaces of the panel, the at least one series of apertures being sized and positioned to engage the at least one MOLLE-type attachment strap such that the first article is secured against one of the first or second surfaces of the panel, the other of the first or second surfaces having one component of a hook-and-loop engagement material, wherein the panel with the first article secured thereto is selectively positionable for attachment to the second article, the second article having a surface with the other component of a hook-and-loop engagement material.

* * * * *